United States Patent [19]
Sailas
[11] 4,452,647
[45] Jun. 5, 1984

[54] HARD-SURFACED CAST IRON ARTICLES AND METHOD AND APPARATUS FOR MANUFACTURING THE SAME

[75] Inventor: Väinö Sailas, Vaajakoski, Finland

[73] Assignee: Valmet Oy, Finland

[21] Appl. No.: 280,344

[22] Filed: Jul. 6, 1981

[30] Foreign Application Priority Data

Jul. 7, 1980 [FI] Finland ..... 802179

[51] Int. Cl.[3] ..... C21D 5/02

[52] U.S. Cl. ..... 148/3; 29/148.4 D; 148/39; 148/145

[58] Field of Search ..... 148/3, 35, 39, 2, 152, 148/145, 151, 1, 138; 219/121 EB, 121 EF, 121 EU, 121 EY; 29/148.4 D, 148.4 R, 132, 110

[56] References Cited

U.S. PATENT DOCUMENTS

| | | | |
|---|---|---|---|
| 2,691,330 | 10/1954 | Van Sciver | 148/145 |
| 3,838,288 | 9/1974 | Stolz et al. | 148/13 |
| 4,000,011 | 12/1976 | Sato et al. | 148/3 |
| 4,154,565 | 5/1979 | Hyde et al. | 148/4 |

FOREIGN PATENT DOCUMENTS

| | | | |
|---|---|---|---|
| 53-13575 | 5/1978 | Japan | 148/141 |
| 53-76121 | 6/1978 | Japan | 148/141 |

OTHER PUBLICATIONS

*Metals Handbook*, vol. 4, 9th edition, 1981, pp. 518–521, American Soc. for Metals.

*Primary Examiner*—L. Dewayne Rutledge
*Assistant Examiner*—S. Kastler
*Attorney, Agent, or Firm*—Steinberg & Raskin

[57] ABSTRACT

A method for manufacturing hard-surfaced cast iron articles, such as rolls for use in the steel industry or paper calendering rolls, includes the steps of casting the article in a manner such that upon cooling the crystal structure of the article is that of grey cast iron and remelting the surface to be treated by directing at least one electron beam onto a zone of the surface to be treated and cooling the remelting zones in a rapid manner so that a hard surface is obtained. The electron beam may be directed onto the zone of the surface to be treated in a punctiform and/or lineal manner, in one or a plurality of partial steps, and in a continuous or stepwise manner. The apparatus of the invention includes at least one electron gun, apparatus for mounting the electron gun and the article relative to each other such that the electron gun can direct an electron beam onto the zone of the surface to be treated to remelt the same and apparatus for displacing the electron gun and article relative to each other.

3 Claims, 9 Drawing Figures

HARD-SURFACED CAST IRON ARTICLES AND METHOD AND APPARATUS FOR MANUFACTURING THE SAME

BACKGROUND OF THE INVENTION

The present invention relates to methods and apparatus for manufacturing hard-surfaced, cast iron articles such, for example, as rolls for use in the steel industry or paper calendering rolls, and the articles obtained by the method.

The manufacture of articles, such as rolls, utilizing casting in chill molds is a technique which is over 100 years old.

The particular method for manufacturing rolls and the associated metallurgical characteristics to be imparted to a roll during manufacture are determined by the particular application to which the roll is to be put. For example, rolls employed in rolling apparatus of the steel industry will substantially differ in these respects from calender rolls used in the paper making industry.

More particularly, conventional rolls used in the steel industry, such as in hot strip rolling mills, can be divided into two categories according to their use, namely, supporting and working rolls. The supporting rolls thus serve the purpose of providing support for the working rolls. Generally, there are usually two of each type of such rolls mounted in a single roll frame. The rolls can be manufactured substantially entirely of cast steel or can in some instances utilize spherical graphite iron. The supporting rolls may be manufactured utilizing socket shells formed as centrifugal castings, the socket shell being fixed upon a base shaft and being replaceable to increase the service life of the roll provided therewith.

The superficial layer of conventional working rolls provided at the initial end of a strip rolling line in the steel industry generally comprises a carbide having a martensitic-bainitic matrix structure. The microstructure of the central portion is generally pearlitic.

The most recently developed rolls used in modern strip roll mills are cast with the central portion thereof comprising cast iron. The mantle of the roll, however, is formed of iron which is alloyed with relatively large amounts of chromium. In this connection, the chromium content in the mantle portion of the roll is usually about 10 to 25%.

The casting of rolls for use in the steel industry as described above is generally accomplished by a static casting process. The manufacturing of high chromium rolls is generally performed using a centrifugal casting process. Thus, in the first steps of manufacturing a high chromium content roll, the high chromium alloy is poured into a rotating chill mold and in a latter step, the central portion of the roll is cast using common cast iron.

The raw material used for sheet rolls for use in the steel industry generally comprises steel or cast iron and has a chemical composition substantially the same as that of the strip roll described hereinabove. A static casting process is used for the manufacture of such rolls. In this connection, the outer surface of the roll is formed of an iron having a composition which differs from that used in the manufacture of the central portion of the roll so that these types of rolls are cast generally in the same manner as part of the strip rolls.

The rolling of profiled, structural steel as conventionally carried out can be generally divided into three steps, namely, rough, intermediate and finishing rolling. Spherical graphite rolls are conventionally used in the rough and intermediate rolling mills although rolls cast of steel are used to some extent. The finishing rolls generally comprise flaked, graphite rolls provided with an indefinite chill. The size of the rolls vary substantially depending upon the purpose to which the roll is put, the rough rolls comprising the largest size rolls having a hardness ranging from about 200 to 300 HB.

The rough rolls are generally cast in a sand mold followed by a normalizing treatment for homogenization.

Spherical graphite rolls are generally used in the intermediate rolling mills, such rolls having a hardness ranging from about 300 to 450 HB. Such rolls generally have a pearlite matrix, the hardness of which may be increased by suitably varying a portion of carbide which results in a carbidic structure which is determined by both the alloying and the effect of the chill mold cooling which occurs.

Rolls of the spherical graphite type may also be cast by a dual casting method by which it is possible to improve the mechanical characteristics of the central portion of the roll.

The material used for finishing rolls generally comprises either a flaked graphite or spherical graphite iron of the sharp boundary and indefinite chill type. The sharp boundary types are generally always cast by a dual casting process and are characterized by a graphite-free hard surface layer containing an abundance of primary carbides. The hardness of the hard surface layer can be suitably selected by on the one hand introducing carbidizing agents, (such as C,Cr,Mo) and on the other hand by influencing the matrix structure. In this connection, the matrix is generally pearlitic in the softer surfaced layers while being generally bainitic-martensitic in the harder surfaced layer. The structure of the rolls central portion is generally pearlitic with an abundance of graphite in either flaked or spherical form.

In the types of rolls formed by an indefinite chill, graphite will occur even in the surface layer thereof. For this reason, the thickness of the hard surfaced layer is difficult to determine thereby giving rise to the term "indefinite chill". However, as the hardness of the surface layer increases, the occurence of graphite becomes more scarce while the proportion of primary carbide becomes higher. This is achieved mainly through the variation of the content of chrome and silicon in the material.

The material used in the central portion of the rolls manufactured by the dual-pouring casting technique is usually soft grey cast iron. In cases where the roll is required to have a high mechanical strength, the material may also be cast of spherical graphite iron.

Turning now to calender rolls used in the paper making industry, such rolls are conventionally manufactured by using a single or direct casting process having sharp boundary characteristics. Thus, the surface layer of such rolls are generally free of graphite while the structure contains an abundance of primary carbide, the matrix including lower alloyed qualities of pearlite and higher alloyed qualities of bainite. At a certain depth below the surface of the roll, the portion of free graphite begins to increase, the material in the central portion of the roll already being soft and containing an abundance of graphite.

It is well known that calender rolls can be cast as solid rolls with an inner axial bore being subsequently formed. Alternatively, the axial bore may be formed using a core in the mold. It is generally considered today that a solid casting followed by a separate boring of the inner opening is superior as a manufacturing technique to the method in which the bore is formed during the casting operation.

Calender rolls have not been subjected to any heat treatment in the past and the casting technique utilized for manufacturing calender rolls is generally simpler than that used for manufacturing rolls used in the steel industry.

According to the prior art, the machining of rolls is accomplished in several working steps, the principle ones of which comprise rough turning, fine turning, rough grinding and then burnishing. The details of the particular steps, of course, depend upon the particular finish specification of the roll surface. Furthermore, journal pins of the rolls must be finished according to the particular usage to which the roll is put. Therefore, roll manufacturing facilities generally have at their disposal the following types of machine tools in numbers determined by production quantity and quality: rough and fine turning lathes, and rough grinding, burnishing, milling, drilling and boring machines. In addition, different types of machine tools are used when machining light, medium weight and heavy rolls.

Hard castings such, for example, as cast iron hard-surfaced rolls, are conventionally cast in permanent, metallic molds or chill molds. Chill molds have a relatively limited service life, only being usable an average of about three times. Since a number of different chill molds is required for a particular application, the cost of such molds represents a major capital investment.

The cast iron of which such hard-surfaced rolls are constituted comprises so-called white cast iron which, due to its hardness, is difficult to machine and, therefore, machining costs are quite high.

SUMMARY OF THE INVENTION

Accordingly, one object of the present invention is to provide new and improved methods and apparatus for manufacturing hard-surfaced cast iron articles, such as rolls for use in the steel industry or paper calendering rolls, which avoid the drawbacks mentioned hereinabove.

Another object of the present invention is to provide new and improved methods and apparatus for manufacturing hard-surfaced cast iron articles which are superior to conventional articles with respect to the implementation of the method as well as the desired characteristics of the finished article.

Still another object of the present invention is to provide new and improved methods and apparatus for manufacturing hard-surfaced cast iron articles and, in particular, a surface treatment for such articles, by which better surface characteristics are obtained.

A further object of the present invention is to provide new and improved methods for manufacturing hard-surfaced cast iron articles wherein the surface to be treated can be provided with varying hardness zone patterns with untreated regions situated between them, according to the particular use intended for the article.

Briefly, in accordance with the present invention, these and other objects are attained by providing a method wherein an article such, for example, as a roll, is cast in a sand mold or the like so that upon appropriate cooling, a grey cast iron crystal structure is obtained for the article whereupon a remelting treatment is carried out using an electron beam or electron beams in order to obtain a superficially hard casting.

The apparatus of the present invention includes an electron gun or electron guns and a vacuum chamber in conjunction therewith having a shape such that the same can be applied in sealing engagement with the surface of the article to be treated. In the case where the article comprises a roll, the apparatus may further comprise means for rotatively and/or axially displacing the roll with respect to the electron gun.

The surface treated of the article, such as a roll, by the method of the present invention has a surface hardness in those regions in which the remelting treatment according to the invention has been carried out on the order of about 500 to 900 HB.

An essential basis for the present invention is the fact that the article is cast in sand or the like so as to solidify as grey cast iron which is relatively soft and easy to machine relative to articles manufactured by chill casting. A rough machining step is performed prior to the remelting treatment. It is understood that it is a conventional technique to cast rolls made of flaked graphite iron or spherical graphite iron in sand molds and that such technique is not as technically exacting as chill casting.

In accordance with the invention, after casting the article, a surface remelting treatment is effected, preferably after the article has been machined close to its final dimensions. At least one electron beam is utilized to effect the surface remelting treatment, an accurately controllable and direct heating effect being obtainable through the use of the electron beam.

The depth of the hard zone produced by the method of the present invention in practice depends upon the power rating of the remelting procedure, the size of the surface to be treated and the duration of the remelting action. In this manner, the depth of the hard zone can be suitably adjusted in an easy manner.

According to the invention, the remelting of the surface to be treated must be of a relatively short duration while the area which is in a molten state at any one time should be small relative to the dimension of the article. In this manner, a self-quenching effect is obtained for the remelted area with no possibility of excessive heating in the regions of the article which are closely adjacent to the area being remelted. Excessive heating of adjacent areas can also be prevented by remelting localized zones of the surface to be treated in a proper sequence and by properly cooling the remelting zones.

After completion of the remelting step, the article is ground to its final dimensions.

The use of an electron beam according to the present invention for effecting the remelting treatment in the manufacture of hard-surfaced articles has the following important practical advantages:

(a) the machining costs of the soft article will be low;

(b) the cost of articles cast in sand are substantially lower than those cast in a chill mold with the exception of relatively simple articles produced in relatively large production quantities, the latter being especially suited for manufacture by a chill casting technique;

(c) the hardness achieveable by the method of the invention is significantly higher than that which can be obtained by conventional casting techniques due to the high rate of cooling;

(d) the remelting treatment according to the present invention can be accurately delimited and various lineal and/or punctiform configurations may be obtained wherein interstitial areas can be left substantially untreated; and (e) an accurate control of the various parameters which influence the implementation of the method of the invention is easily obtained.

DESCRIPTION OF THE DRAWINGS

A more complete understanding of the invention and many of the attendant advantages thereof will be readily understood by reference to the following detailed description when considered in connection with the accompanying drawings in which.

DESCRIPTION OF THE PREFERRED EMBODIMENTS

A brief discussion of the metallurgy involved in the remelting treatment of the present invention will now be set forth with reference to the iron/carbon phase diagram of FIG. 3 which displays the stable or permanent system in dotted lines and the metastable or semi-permanent system designated by solid lines.

Alloys having a composition containing less than about 2% carbon are generally classed as steels while alloys having a composition containing more than 2% carbon are generally classed as cast irons. Of course, the microstructure created at the solidification of cast iron and during the subsequent cooling is determined by the composition of the iron, the cooling rate and the treatment of the melt.

Figure 3:
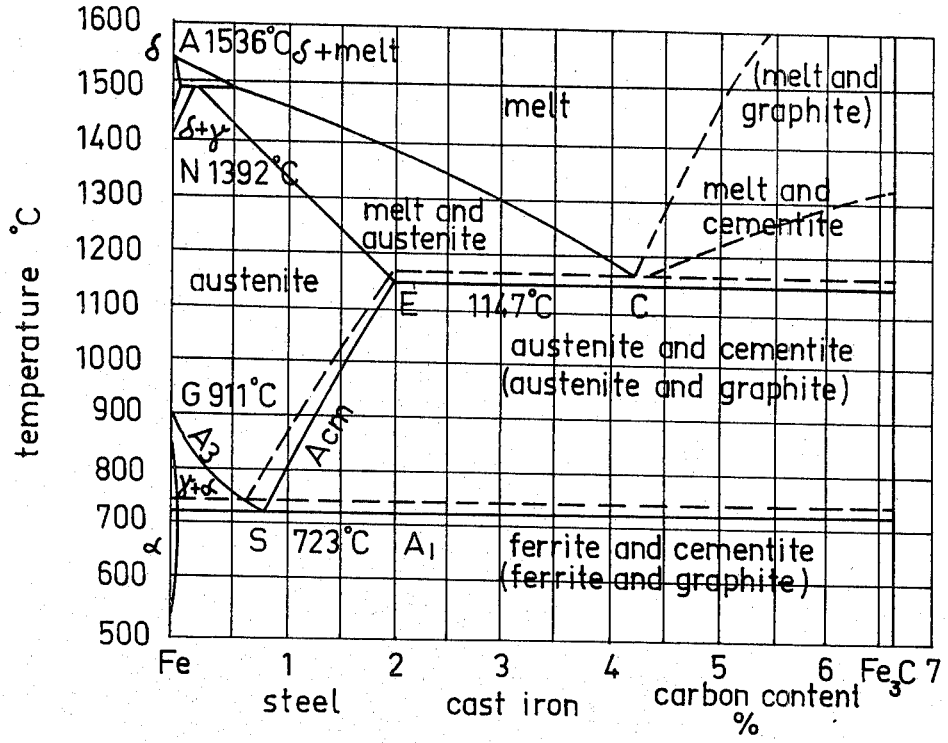
FIG. 3 is the iron/carbon phase diagram to which reference is made to clarify the background of the invention.

When the cooling rate is relatively slow during crystallization of the melt and subsequent cooling, the crystallization will take place in accordance with the stable system indicated by dotted lines in FIG. 3. Such structure will be formed with a matrix consisting of ferrite and pearlite in which graphite has crystallized in the form of flakes or spheres (flaked and spherical graphite iron, respectively). Such iron is generally called grey iron, referring to the color of its fracture surface, as distinguished from so-called white iron which is formed on cooling according to the metastable system. The microstructure of white iron consists of pearlite and cementite without the occurrence of graphite in free form. Very fast post-solidification cooling results in the formation of martensite in the matrix structure.

The hardness of cast irons solidified to grey iron varies, depending upon the hardness class, in the range of between about 120 to 330 HB. Of the various phases present in the microstructure, graphite is the softest and has virtually no strength, ferrite has a hardness of between 70 and 150 HB, while ferite is quite ductile. By reason of the presence of graphite as described above, grey cast iron is easy to machine and easily castable in view of its strength.

On the other hand, white cast iron is rendered extremely hard and abrasion-resistant through the presence of cementite or iron carbide ($Fe_3C$) in its microstructure. Cementite is extremely hard, having a hardness of between about 800 and 1100 HB and due to its high hardness, cementite is quite brittle. Martensite has a hardness almost as high as cementite. A graphite free, white cast iron structure can be achieved by rapid cooling, by selecting a composition which facilitates metastable solidification, and/or by employing suitable carbidizing alloying agents.

It is usually a practice in surface hardening cast iron and steel to heat the superficial layer of the article to a temperature at which the structure turns austenitic according to the phase diagram of FIG. 3. During the subsequent cooling, there is no formation of any structures consistent with equilibrium conditions since insufficient time is provided for the formation of such structures and hard and brittle martensite is formed instead. The hardening depth may be as small as 1 to 1.5 mm. The soft graphite in cast iron will still remain in the structure.

In the remelting treatment of the cast surface of articles, such as rotational bodies or the like, according to the present invention, the temperature of the surface of the article is raised by directing at least one electron beam onto the surface to be treated of the article in a localized manner with sufficient power such that the cast iron melts. When the heating is discontinued, an exceedingly rapid cooling occurs due to the fact that the heat liberated at solidification and cooling is efficiently dissipated in the cast iron article itself. In other words, a so-called self-quenching takes place. Due to the rapid cooling, the remelted surface solidifies as white iron and forms a hard and abrasion-resistant surface while the interior of the article retains its ductility as well as the good vibration damping capacity typical of cast iron which contains free graphite and which has solidified in a grey state.

Thus, a necessary prerequisite for the remelting treatment according to the present invention is the melting of the surface to a desired treatment depth and a subsequent rapid cooling. The rate of cooling will be sufficiently great if the thickness of the melted layer is small compared with the thickness of the article while the heating is so fast that the heat used in raising the temperature of the localized zone onto which the electron beam is directed does not have time during the heating step to be conducted into the article to any significant extent. The critical cooling rate necessary for solidification to white cast iron may be lowered by reducing the so-called carbon equivalent, i.e., the composition of the cast iron, or by employing suitable carbidizing alloying substances. This is not usually necessary, however.

Figure 1:
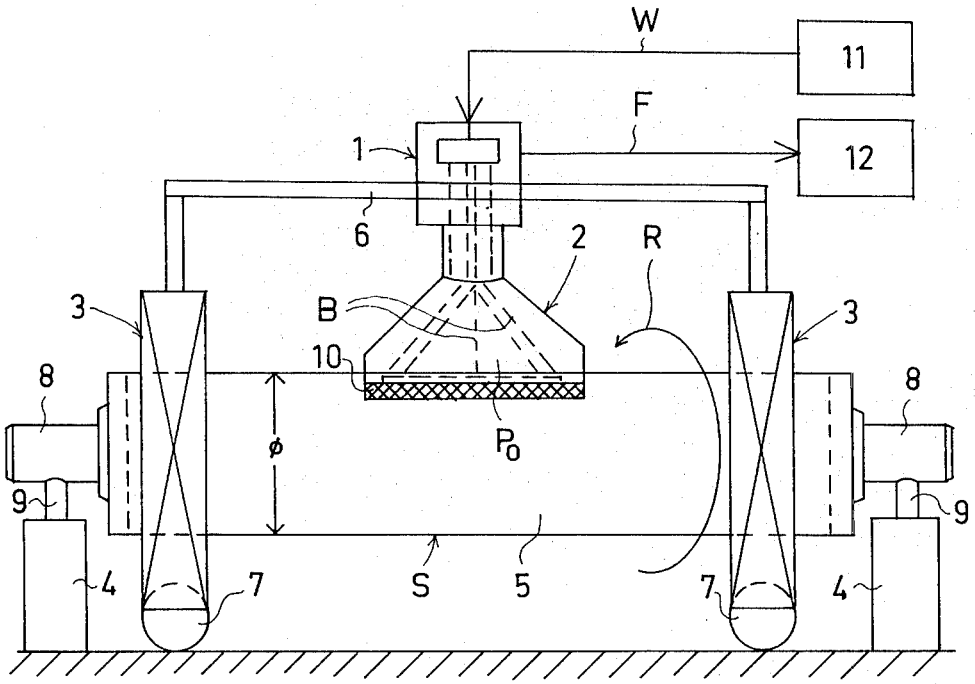
FIG. 1 is a side elevation view of apparatus according to the present invention for performing the method of the present invention, the article to be treated being illustrated as a paper calendering roll.
Figure 2:
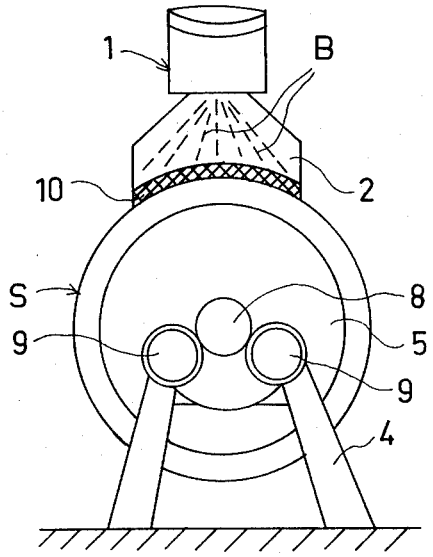
FIG. 2 is an elevation view of the apparatus illustrated in FIG. 1 taken in the axial direction of the roll under treatment.

Referring to FIGS. 1 and 2 which illustrate apparatus according to the present invention and which will function according to the method of the invention, the article being treated is illustratively illustrated as a paper or cardboard calendering roll 5 which has been cast as common grey cast iron prior to the remelting treatment in a refractory mold.

The apparatus of the present invention comprises an electron gun 1 provided in conjunction with a vacuum chamber 2. The electron gun 1 is of conventional design and is adapted to direct one or more electron beams onto the surface S to be treated of the article 5. In this manner, the temperature of the surface can be elevated to a degree such that a phase transformation is possible so that in this manner a hard layer is formed on the surface of the roll.

The electron beams B will have the greatest effect when the same pass through a vacuum. To this end, a vacuum chamber 2 is provided through which the electron beams B are directed onto the surface S of the roll 5. The vacuum chamber 2 includes sealing members 10 provided along the margins of its open side which sealingly engage the surface S of roll 5 to provide the interior of the vacuum chamber 2 with a subatmospheric pressure. The vacuum chamber 2 is connected to a suction pump 12 by a connector F as schematically illustrated. Moreover, the electron gun 1 is supplied with requisite electric energy W from a power source 11, also schematically illustrated.

According to the illustrated embodiment, the roll 5 being treated is mounted on its journal pins 8 for rotation as illustrated by the arrow R. The journal pins 8 are carried by bearing mounted supporting rollers 9 so that in this manner, the roll 5 can be rotated on rollers 9 during the remelting treatment as described in greater detail below.

The structure of the apparatus which mounts the roll 5 includes a pair of inverted U-shaped frame parts provided with wheels 7 and which are interconnected by means of a horizontal beam 6. The electron gun 1 together with the vacuum chamber 2 is mounted on beam 6. It is understood that the illustration of frame parts 3 and 6 have been omitted from FIG. 2 for purposes of clarity.

The remelting treatment of the surface S of the roll 5 preferably commences at one end of the roll. During the remelting treatment, the roll is displaced, both rotatably and axially. In other words, upon commencement of the remelting treatment of the surface S of the roll 5, the roll is rotated while the frame structure 3 and 6 is axially displaced, i.e., displaced in the direction of the axis of the roll, on wheels 7. In this manner, the remelting treatment can be applied over the entire length of the cylindrical surface of the roll. In this connection, it may be advantageous to utilize a plurality of partial steps whereby in each step, only a portion of the surface S is treated with, however, the entire length of the roll being treated in each such partial step.

In order to prevent excessive heating of the workpiece 5 and the generation of thermal stresses, different treatment sequences may be applied. Thus, it is possible through appropriate movement of the electron beam to carry out the remelting treatment in various manners such, for example, as in discrete spots, lineally or progressing in a uniform manner. The treatment may commence at several points simultaneously and gradually proceed until the entire surface has been treated.

Referring to FIGS. 4–8, various modes of carrying out the organization and treatment pattern of the melting treatment are illustrated. In FIGS. 4–8, the article being treated constitutes a roll and the arrows R indicate the direction in which the roll is rotated, developed in the plane. The characters n.1, n.2, etc., designate treatment patterns initiated in one particular treatment step and progressing simultaneously. The numerals 1, 2, 3, etc. alone indicate the time of such treatment, i.e., the particular order of the plurality of partial treatment steps.

Figure 4:
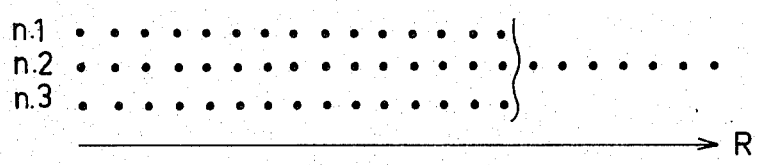
FIGS. 4–8 are diagrammatic views of various remelting modes and patterns which are possible according to the method of the present invention.

Referring to FIG. 4, the remelting treatment is carried out in a lineal configuration constituted by consecutive discrete zones in the form of dots.

Figure 5:
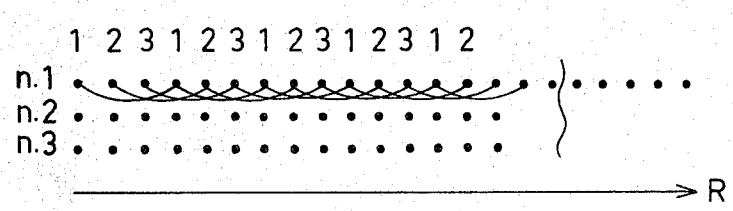

In FIG. 5, consecutive lineal configurations are formed in a plurality of partial steps, each step including the treatment of several discretes zones in the form of dots being accomplished simultaneously in each partial step.

Figure 6:
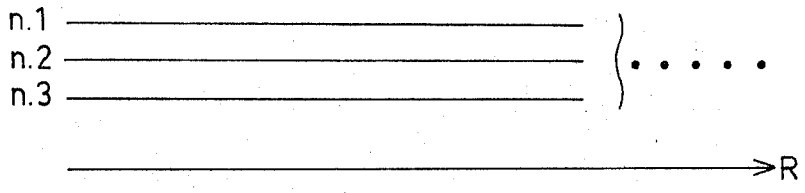

In the FIG. 6 variation, the treatment pattern is formed by an electron beam which proceeds at a uniform rate and for lineal treatment, the requisite number is applied at a constant spacing. It is understood in connection with the FIG. 6 pattern that a lineally proceeding treatment may start simultaneously at several points as shown in the figure. Of course, it is understood that the treatment may use any particular succession of treatment steps which is best appropriate depending upon the shape and dimension of the article being treated.

Figure 8:
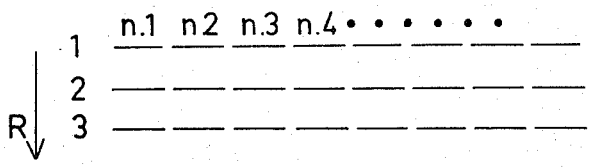

In the FIG. 8 variation, the treatment is carried out by effecting several simultaneous lineal electron beam sweeps in one axial plane of the roll, such sweeps being repeated at given, suitable intervals while the roll rotates in the direction of the arrow R.

Figure 7:
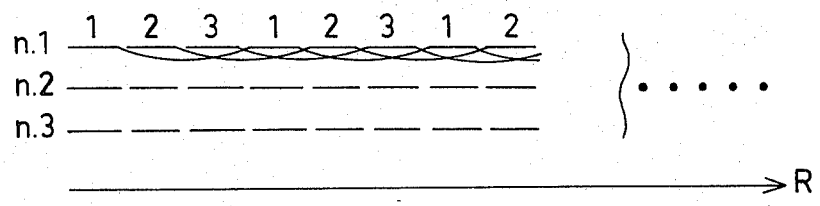

The variation of FIG. 7 is similar to that of FIG. 5 except that the remelting zones constitute lineal electron beam sweeps of limited extent.

Figure 9:
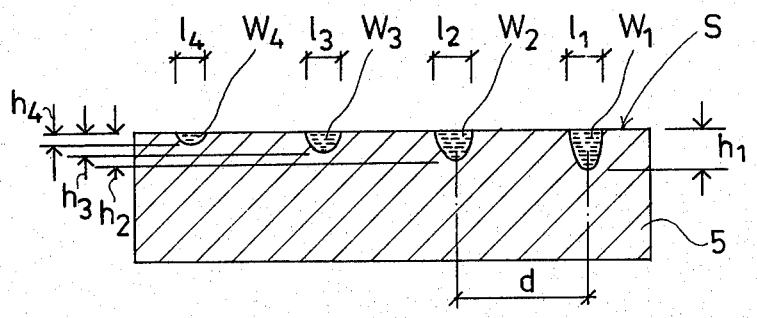
FIG. 9 illustrates cross-sections of various alternative treatment patterns in the radial plane of the article.

Referring to FIG. 9, various penetrations depths of remelting zones are illustrated in a section view which is parallel to the axial plane of a roll 5. The remelting zone $W_1$ has a width $l_1$ and a depth $h_1$, the ratio $l_1/h_1$ being about 2. In the next example, the cross section $W_2$ of the remelting zone has an axial breadth $l_2$ and depth $h_2$, the breadth $l_2$ being slightly larger than the depth $h_2$. In the region $W_3$, the breadth $l_3$ is substantially equal to the depth $h_3$. In the region $W_4$, the breadth $l_4$ substantially exceeds the depth $h_4$. The mutual axial spacing of the remelting regions $W_1$ to $W_4$, indicated by d, is suitably selected according to the intended use of the roll. The untreated intervals between the remelting zones $W_1$ to $W_4$ may, if required, be remelted in a later partial step of the procedure.

The depth of penetration of the electron beam and the extent and depth of the melting zone depend upon the electric power rate W applied to the electron gun as well as on the speed of treatment. When it is desired to accomplish a deep penetration and high cooling rate of the melt, sufficient power should be supplied with a view to preventing excessive thermal conduction. Further, the treatment time should be suitably short.

As noted hereinabove, prior to effecting the remelting treatment, the rough machining of the article is carried out. Subsequent to the surface treatment, the fine machining of the article to its ultimate desired dimensions is carried out.

Although various punctiform and lineal treatment patterns have been illustrated in connection with FIGS. 4–9 and which may be highly advantageous, for example, in the case of a paper machine calender roll since the same imparts to the surface both sufficient hardness and elasticity, it should be understood that it is within the scope of the present invention to treat the entire surface to be treated in a single coherent remelting operation. In fact, such a surface treatment of the entire surface to be treated may be advantageous in certain instances.

The method of the present invention is particularly well suited for the treatment of articles having the shape of a body of rotation, in particular, in the treatment of cylindrical articles, since the electron beam remelting treatment can be accomplished by suitably rotating the roll and by axially displacing the vacuum chamber 2, in either a continuous or stepwise manner. When treating larger articles according to the present invention, a vacuum chamber 2 of the type described above should be employed. However, when smaller articles are being manufactured, a vacuum chamber which can accommodate the entire article may be utilized. However, the advantages of the present invention are most apparent in the treatment of larger cylindrical objects, such as cast iron rolls of the type described above.

A typical range for the diameter of the rolls suitable for treatment by the method of the present invention is about 300 to 1300 mm. The typical power rating W for the electron beam is about 20 kW. By using a power input of this order of magnitude, a sufficiently high power loading per unit area of surface to be treated can be obtained at reasonable speeds of rotation and axial displacement.

As noted above, the present invention also comprises apparatus for carrying out the method of the invention as well as an article manufactured according to the method invention and, in particular, a roll for use in the steel industry or paper and cardboard calendering rolls. The important feature of a roll or other type or article manufactured according to the present invention is that the surface hardness thereof in those regions where a remelting treatment according to the invention has been carried out is on the order of 500 to 900 HB, whereas in rolls manufactured in accordance with conventional techniques, maximum hardnesses of only about 500 to 600 HB can be obtained. Furthermore, advantageous embodiments of the roll or other article according to the present invention are characterized in that the surface of the article has a treatment pattern which may comprise a punctiform, lineal or equivalent configuration and between which are found substantially untreated articles or patterns or the like with lower hardnesses. A roll according to such an embodiment is advantageous in that, for example, a calender roll having harder, lineal or punctiform regions situated between softer and more ductile grey cast irons areas will provide a structure which combines adequate surface hardness and structural strength.

Obviously, numerous and variations of the present invention are possible in the light of the above teachings. It is therefore to be understood that within the scope of the claims appended hereto, the invention may be practiced otherwise than as specifically disclosed herein.

What is claimed is:

1. A method for manufacturing hard-surfaced cast iron rolls, comprising the steps of:

casting the roll and cooling the same in a manner such that, upon completion of said cooling, the crystal structure of the roll is that of grey cast iron;

machining the roll substantially to its final dimension;

mounting the roll for rotation about an axis of rotation;

remelting the roll surface to be treated by directing at least one electron beam onto zones of the roll surface to be treated and rotatably displacing the roll and axially displacing the electron beam relative to each other to direct the at least one electron beam onto different remelting zones in a punctiform manner;

cooling the treated roll surface; and machining the roll to its final dimensions and surface smoothness subsequent to said remelting and cooling steps.

2. A method for manufacturing hard-surfaced cast iron rolls, comprising the steps of;

casting the roll and cooling the same in a manner such that, upon completion of said cooling, the crystal structure of the roll is that of grey cast iron;

machining the roll substantially to its final dimension;

mounting the roll for rotation about an axis of rotation;

remelting the roll surface to be treated by directing at least one electron beam onto a zone of the roll surface to be treated and rotatably displacing the roll in a continuous manner and axially displacing the electron beam relative to the roll to direct the at least one electron beam onto different remelting zones;

cooling the treated roll surface; and machining the roll to its final dimensions and surface smoothness subsequent to said remelting and cooling steps.

3. A roll manufactured by a method comprising the steps of:

casting the roll and cooling the same in a manner such that, upon completion of said cooling, the crystal structure of the roll is that of grey cast iron;

machining the roll substantially to its final dimension;

mounting the roll for rotation about an axis of rotation;

remelting the roll surface to be treated by directing at least one electron beam onto zones of the roll surface to be treated and rotatably displacing the roll and axially displacing the electron beam relative to each other to direct the at least one electron beam onto different remelting zones in a punctiform manner;

cooling the treated roll surface to define a punctiform pattern of treated hardened zones and untreated zones of lower hardness; and machining the roll to its final dimensions and surface smoothness subsequent to said remelting and cooling steps; and wherein the final surface harness of the treated surface of the roll is in the range of about 500 to 900 HB and wherein the treated roll surface is defined by a pattern of treated hardened zones between which are substantially untreated zones of lower hardness.

* * * * *